US005518202A

United States Patent [19]

Focke et al.

[11] Patent Number: 5,518,202

[45] Date of Patent: May 21, 1996

[54] PROCESS AND APPARATUS FOR CONNECTING MATERIAL WEBS, IN PARTICULAR OF PACKAGING MATERIAL

[75] Inventors: Heinz Focke; Harald Gosebruch, both of Verden; Henry Buse, Visselhövede, all of Germany

[73] Assignee: Focke & Co. (GmbH & Co.), Verden, Germany

[21] Appl. No.: 284,119

[22] Filed: Aug. 2, 1994

[30] Foreign Application Priority Data

Aug. 3, 1993 [DE] Germany ..... 43 25 944.8

[51] Int. Cl.[6] ..... B65H 19/14; B65H 19/18

[52] U.S. Cl. ..... 242/552; 242/556.1; 242/562.1

[58] Field of Search ..... 242/552, 556.1, 242/562.1, 562

[56] References Cited

U.S. PATENT DOCUMENTS

| | | | |
|---|---|---|---|
| 2,987,108 | 6/1961 | Kilmartin . | |
| 3,165,276 | 1/1965 | Stone et al. | 242/556.1 X |
| 3,514,363 | 5/1970 | Stone et al. | 242/556.1 X |
| 4,812,198 | 3/1989 | Fuke et al. | 242/556.1 X |
| 4,881,695 | 11/1989 | Beisswanger | 242/556.1 |
| 5,169,082 | 12/1992 | da Silva | 242/562.1 X |
| 5,328,114 | 7/1994 | Boldrini et al. | 242/562 |
| 5,381,983 | 1/1995 | Sakano et al. | 242/562.1 |
| 5,385,316 | 1/1995 | Weiss | 242/552 |

FOREIGN PATENT DOCUMENTS

| | | |
|---|---|---|
| 0263920 | 4/1988 | European Pat. Off. . |
| 299181 | 1/1989 | European Pat. Off. . |
| 1574392 | 1/1979 | Germany . |
| 3144786 | 5/1983 | Germany . |
| 2652411 | 4/1989 | Germany . |

*Primary Examiner*—John M. Jillions
*Attorney, Agent, or Firm*—Sughrue, Mion, Zinn, Macpeak & Seas

[57] ABSTRACT

In order to connect a new web (13), which is to be drawn off from a new bobbin (12), to a runoff web (10), drawn off from a runoff bobbin (11), of packaging material, a free end, namely an end piece (25), of the new web (13) is gripped by a drawing-off member (20) and drawn in one conveying cycle into the region of a connecting assembly (18). The runoff web (10) also runs through the connecting assembly (18). In the region of the connecting assembly (18), the two webs are laid against one another and are severed jointly by a cutter (41). After removing a web piece (45) of the runoff web (10), the web end (32), of the runoff web (10), and the web beginning (33) of the new web (13) are free. A connecting strip (47) can be brought to bear, from the free side, against the two webs.

7 Claims, 6 Drawing Sheets

PROCESS AND APPARATUS FOR CONNECTING MATERIAL WEBS, IN PARTICULAR OF PACKAGING MATERIAL

BACKGROUND OF THE INVENTION

The invention relates to a process for connecting material webs of packaging material, namely connecting (1) a web beginning of a new web wound as a new bobbin to (2) a web end of a runoff web running off from another runoff bobbin, the web beginning of the new web being gripped on the circumference of the new bobbin by a drawing-off member, being drawn off from said new bobbin and being connected, in the region of a connecting assembly, to the web end of the runoff web by adhesive bonding or the like. The invention further relates to an apparatus for carrying out the process.

The invention is concerned with the handling of wound, web type packaging material (bobbins) of paper, tin foil or polymer films in conjunction with packaging machines. The aim is to carry out, even in the case of high performance packaging machines, an automatic exchange of the bobbins, that is to say Joining of a new, "full" bobbin (new bobbin) to the running material web (runoff web).

SUMMARY OF THE INVENTION

The object of the invention is to ensure, with the aid of simple members, reliable joining of the new web of a new bobbin to the runoff web.

In order to achieve this object, the process according to the invention is characterized in that, by means of the drawing-off member, a web portion being drawn off, the new web is drawn in one conveying cycle into the region of the connecting assembly and beyond this and is retained until it is connected to the runoff web.

The drawing-off member configured in terms of the invention is preferably a pivot arm which can move back and forth in a vertical plane and, at the free end, exhibits a securing means, in particular a receiving roller having suction bores. Such a receiving roller grips an end piece of the new web and fixes the same by winding up and by suction air. It is important that the drawing-off member grips the new web on the new bobbin, draws it off from the new bobbin and transports it into the position for connection to the runoff web. The drawing-off member or the retaining means for the new web is accordingly conveyed, along with the new web, through the connecting assembly and retained in a position which is favourable for the connecting procedure.

In the region of the connecting assembly, the new web and runoff web are pressed against one another, severed jointly and then connected to one another in order to form a continuing web. Thereafter, the drawing-off member returns into the initial position.

Further features of the invention relate to the configuration and mode of operation of the drawing-off member and of the connecting assembly.

Exemplary embodiments of the apparatus according to the invention and of its mode of operation are illustrated in more detail hereinbelow with reference to the drawings, in which:

DESCRIPTION OF THE PREFERRED EMBODIMENTS

Figure 1:
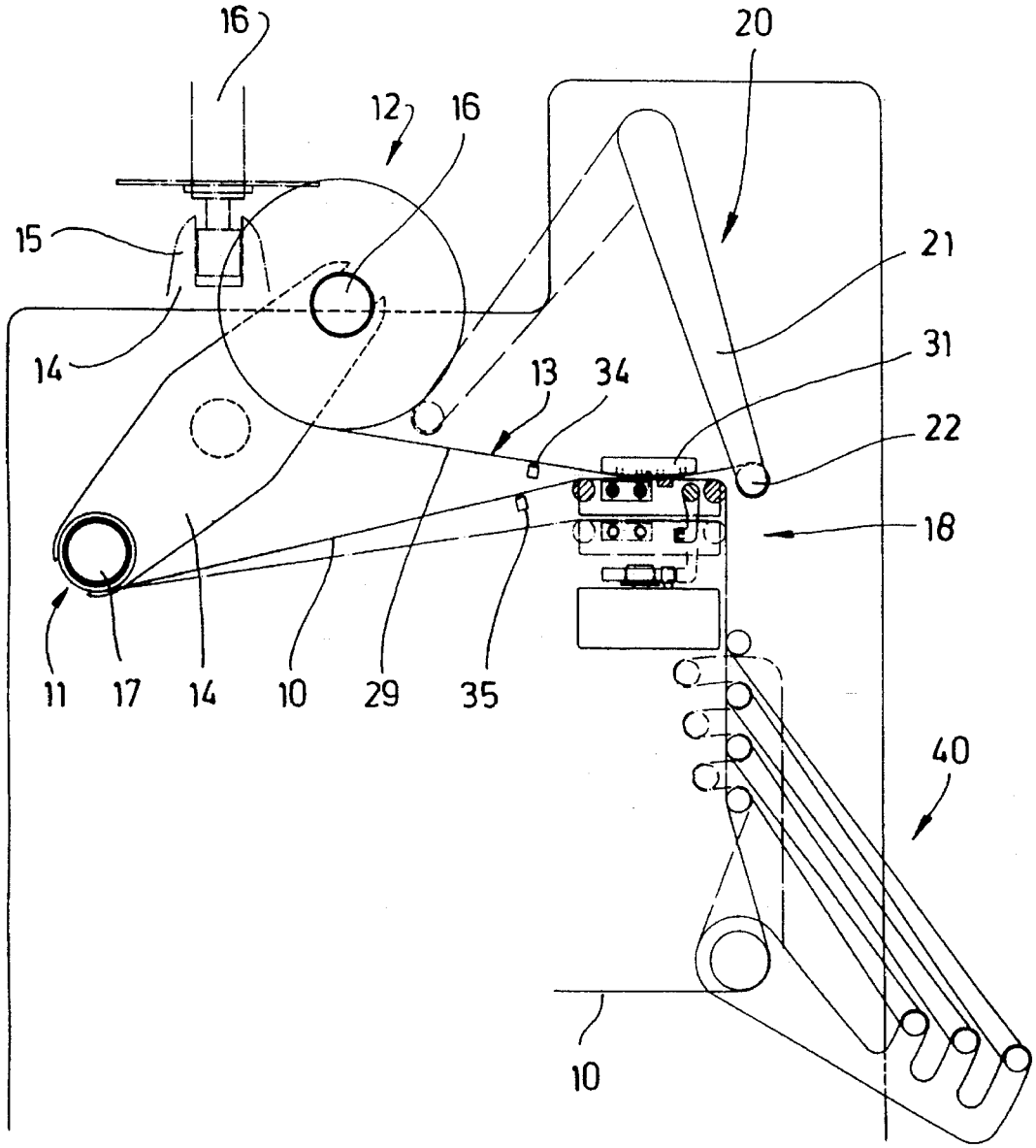
FIG. 1 shows a schematic side view of the complete connecting apparatus for material webs.

Represented in the drawings is an exemplary embodiment for a web-connecting apparatus which is used in conjunction with a packaging machine. In particular, said assembly can be used in the case of cigarette-packaging machines. The material webs which are to be handled comprise packaging material, for example paper, plastic or tin foil.

A running-off material web, that is to say a runoff web 10, is fed, during continuous conveying, to the packaging machine. Said runoff web is drawn off from a bobbin, namely from a runoff bobbin 11. A second "full" bobbin, that is to say a new bobbin 12, is held at the ready. The aim is, after the runoff bobbin 11 has been used up, to join a new web 13, which is to be drawn off from the new bobbin 12, to the runoff web 10.

The two bobbins, namely the runoff bobbin 11 and new bobbin 12, are rotatably mounted, preferably in a motor-driven manner, on a two-armed rocker 14. Free ends of the rocker 14 are configured as a fork 15. This facilitates the feed of new, full bobbins to the web-connecting apparatus. As shown in FIG. 1 in broken lines, the rocker 14, in order to receive a new bobbin, is rotated into an upright position. A bearing journal 16, 17 for receiving a bobbin is pivotably mounted in each fork 15. In a horizontally directed position, that is to say transversely with respect to the rocker 14, the bearing journals 16, 17 are in an operating position. The material webs can be drawn off from the respective bobbin. In order to feed a new bobbin, the bearing journal 16 or 17 of the respectively upwardly directed fork 15 is pivoted into an upright position. A new bobbin can then be positioned onto the bearing journal 16, 17 from above.

Two sub-assemblies belong to the web-connecting apparatus. One of these is a member for receiving the new web 13 during the beginning of the web-connecting procedure. The other is a connecting assembly 18 which produces the connection between the runoff web 10 and the new web 13.

The runoff bobbin 11 is monitored by suitable, known monitoring members in terms of how much of it is left. At the appropriate time, preparations are made to join the new web 13 to the runoff web 10. The rocker 14 is located in an obliquely directed position in which the runoff bobbin 11 is at the bottom and the new bobbin 12 is at the top. The aim then is for a front end 19 of the new web 13 to be gripped and fed to the connecting assembly 18. A drawing-off member 20 is provided for this purpose. Said drawing-off member is configured here as a pivot arm 21 which can move back and forth in a vertical plane between a receiving position (shown in broken lines) on the new bobbin 12 and a transfer position in the region of the connecting assembly 18. Located at the free end of the pivot arm 21 is a receiving head for the front end 19, this being a rotatable receiving roller 22 in the case of the present exemplary embodiment. Said roller is provided with a plurality of radially directed suction bores 23 which are joined to a subatmospheric-pressure source.

The new web 13 is connected releasably namely by a peel-off adhesive join to a wound turn 24, of the new bobbin 12, located therebeneath. The fastening of a region directed towards the front end 19 and belonging to the new web 13 is selected such that a free, that is to say non-fastened, end piece 25 having length of, for example, a few centimeters, is formed. The free end piece 25 can also be formed by an adhesive strip 26, by means of which the front end 19 of the new web 13 is fastened on the wound turn 24. The adhesive strip 26 exhibits an adhesive region 27, which fixes the front end 19 as well as the adhesive-free end piece 25.

Figure 2:
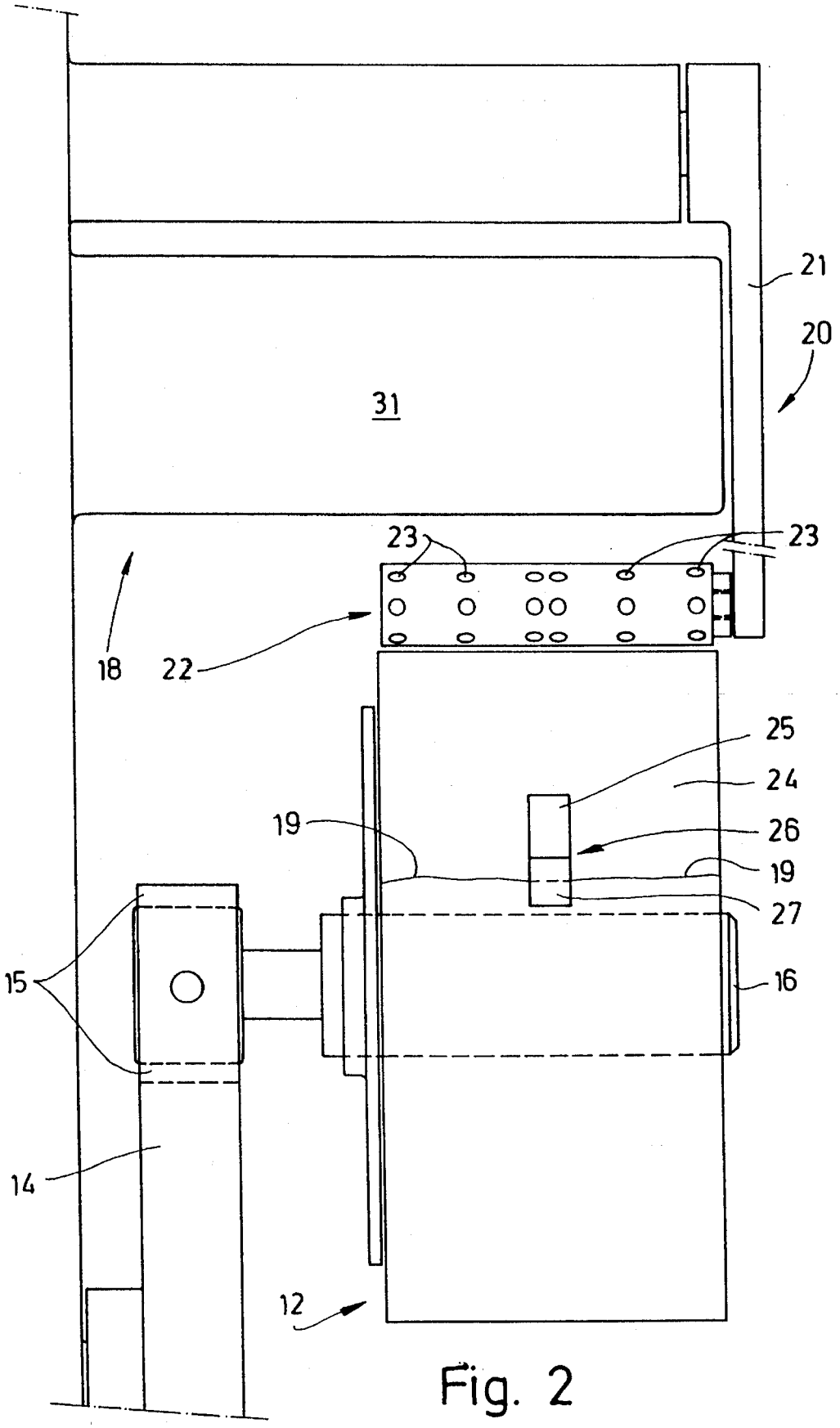
FIG. 2 shows, on an enlarged scale, a detail of the apparatus in plan view, namely a drawing-off member for a new material web
Figure 3:
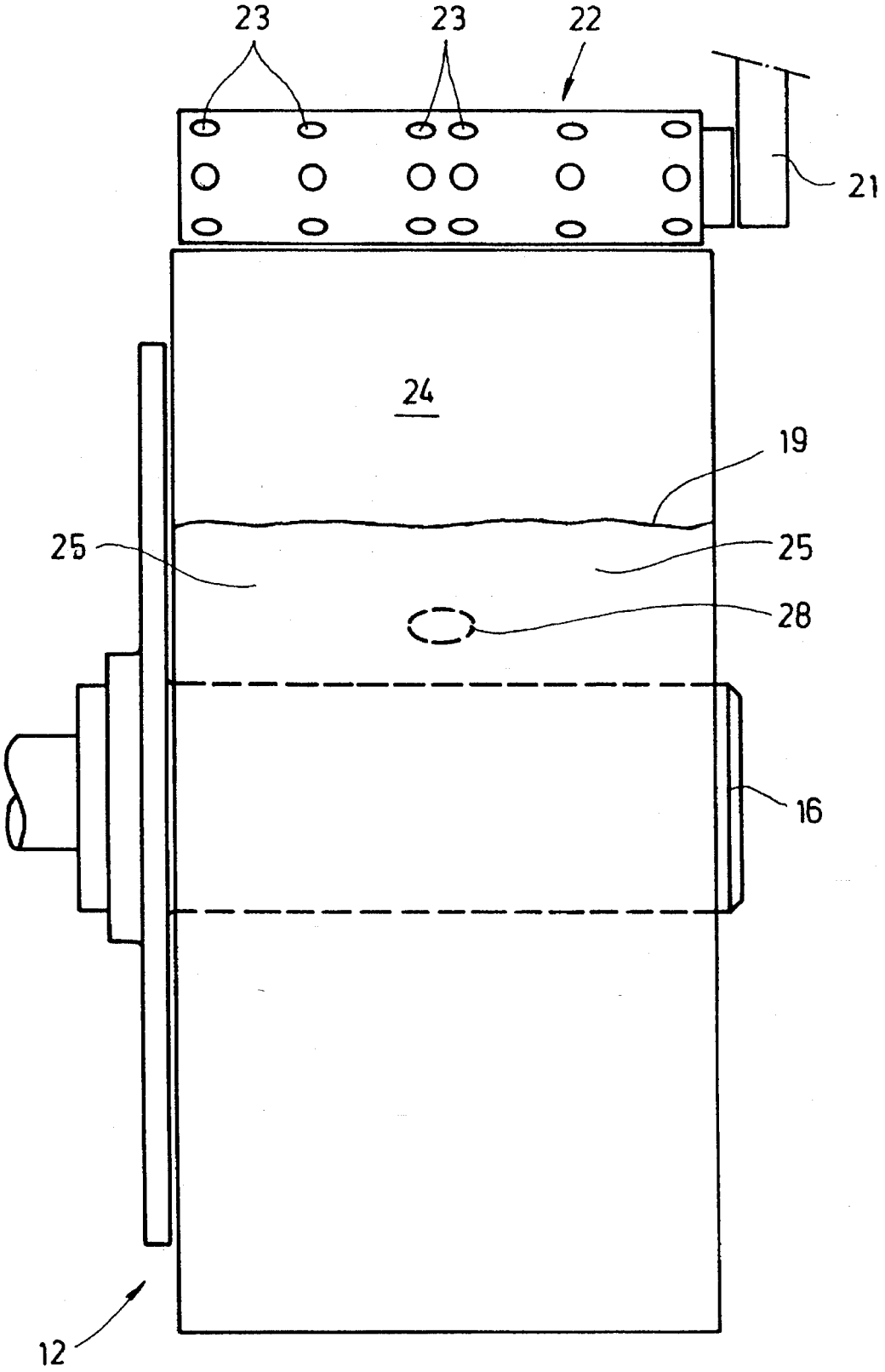
FIG. 3 shows, again on an enlarged scale, a detailed view of FIG. 2 with an alternative in terms of a specific detail.

In the embodiment according to FIG. 3, the new web 13 is connected to the wound turn 24 by an adhesive joint 28. The latter is provided at a distance from the front end 19, this producing the free end piece 25. The drawing-off member 20 grips the free end piece 25 and then draws off a web portion 29, releasing the adhesive connection from the new bobbin 12 in doing so. A corresponding procedure applies for receiving the new web 13 when the latter is fixed by an adhesive strip 26 (FIG. 2). For secure gripping of the end piece 25, the receiving roller 22 is provided, particularly in the central region, with a plurality of suction bores 23, namely with two closely adjacent rings of suction bores 23, in particular in the region of the adhesive strip 26.

Figure 4:
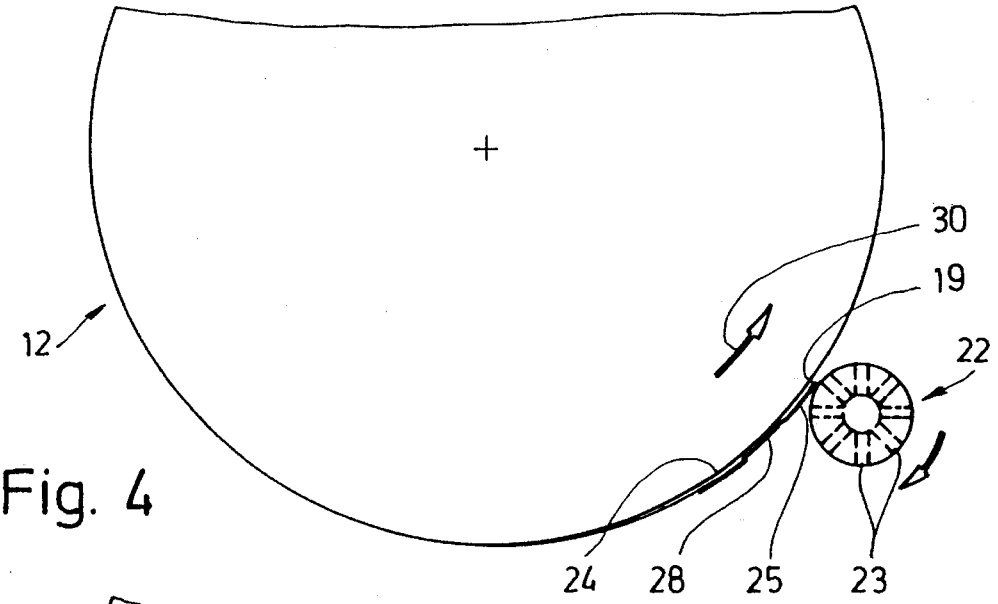
FIGS. 4 to 6 show, in side view, various positions of a head of the drawing-off member when receiving a new material web.
Figure 5:
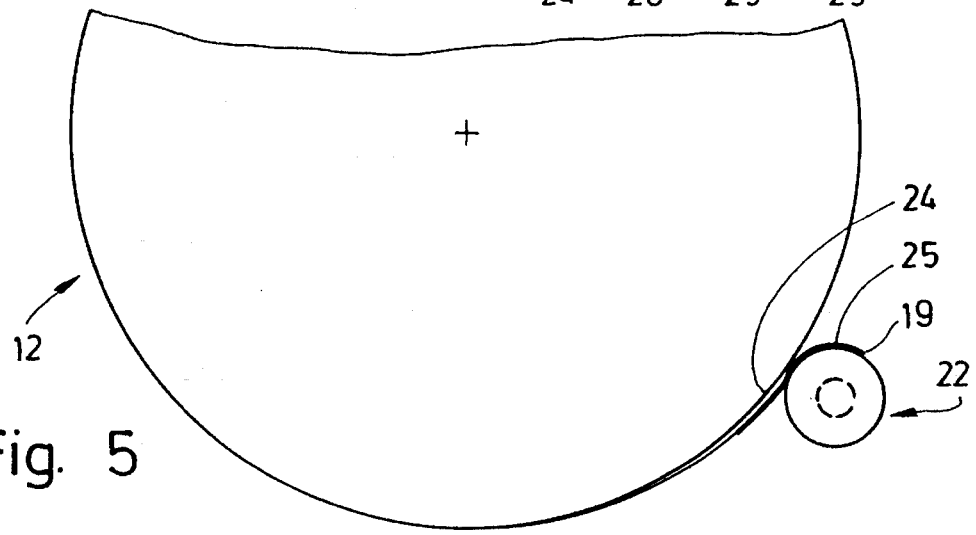
Figure 6:
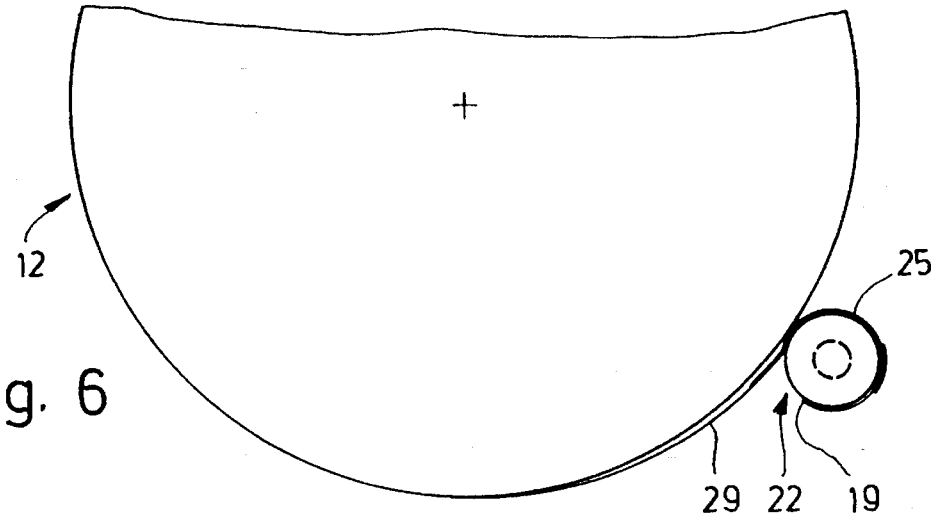
Figure 7:
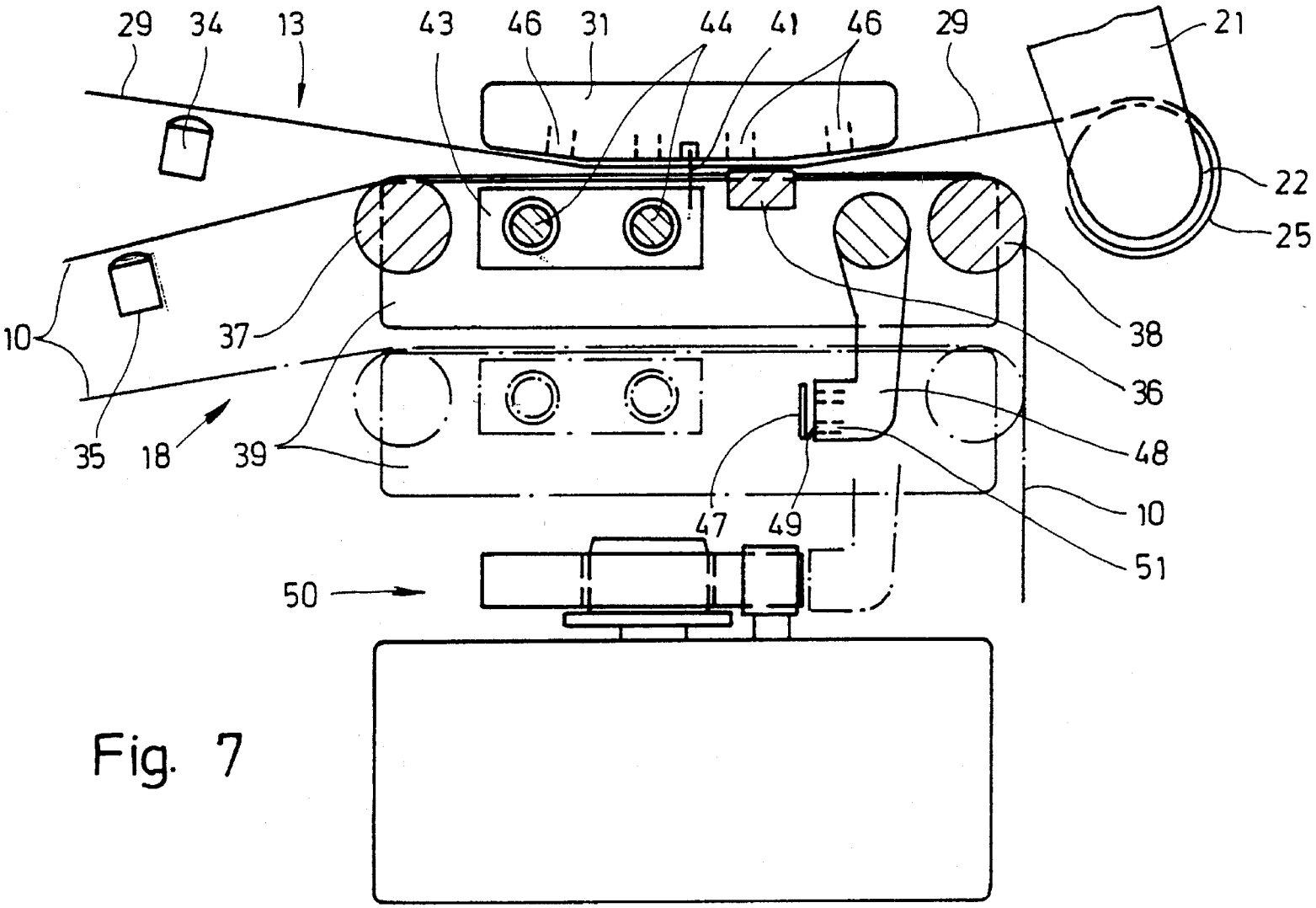
FIG. 7 shows a web-connecting assembly in side view, partly in vertical section.

For receiving the end piece 25 by the drawing-off member 20, the head, that is to say the receiving roller 22, is moved until it butts against the circumferential surface of the new bobbin 12. The latter is then driven in rotation, to be precise in the unwinding direction, that is to say in the direction of the drawing-off movement of the new web 13 corresponding to direction arrow 30 (FIG. 4). The receiving roller 22 is correspondingly driven in rotation in the opposite direction. The rotary movements are carried out until the free end piece 25 rests on the circumference of the receiving roller 22 and is gripped by the suction bores 23 (FIG. 5). A drawing-off force is then exerted on the end piece 25 and the adhesive connection until a sufficient piece of web is gripped by the receiving roller 22.

Figure 8:
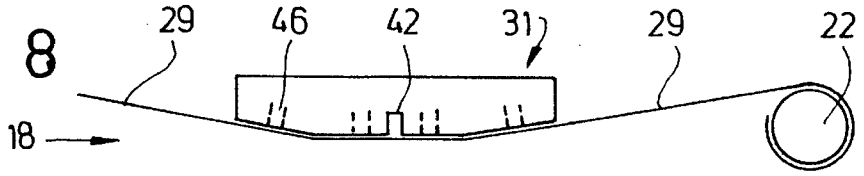
FIGS. 8 to 12 show various positions in the region of the web-connecting assembly during the connection of a new material web to a running-off material web.
Figure 9:
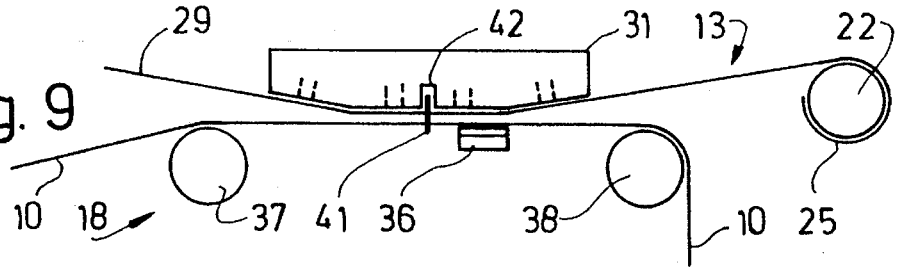

The drawing-off member or the pivot arm 21 thereof is then moved in the direction of the connecting assembly 18, and beyond the same. The drawing-off movement of the new web 13 or of the web portion 29 takes place such that the latter rests on the underside of a pressure plate 31 of the connecting assembly 18 (position according to FIG. 8). The new web 13 or the web portion 29 provided for connection to the runoff web 10 is accordingly moved by the drawing-off member 20 in one movement cycle from the receiving position on the new bobbin 12 to the end position in the region of the connecting assembly 18. The web portion 29 is retained in the correct position by the drawing-off member 20 until the actual web-connecting procedure is started. During the drawing-off procedure, the new bobbin 12 may additionally be driven in the direction of rotation by a motor. The movement plane of the pivot arm 21 lies outside, or next to, the connecting assembly 18.

The task of the connecting assembly 18 is to form a web end 32 (FIG. 10) of the runoff web 10 and a web beginning 33 of the new web 13, to position them in a precise relative position, namely directly adjacent to one another, and then to connect them to one another.

For this purpose, the runoff web 10 and new web 12 are laid against one another, in the region of the connecting assembly, and severed jointly. Consequently, the web end 32 and web beginning 33 lie directly one beside the other. The runoff web 10 and new web 13 can thus be connected to one another in an uninterrupted manner.

The special configuration of the connecting assembly and the feed of the new web 13 to the same in one movement cycle of the drawing-off member 20 permits the positionally accurate transfer of the new web 13 or of the web portion 29 to the connecting assembly 18. In this manner, the exact position of the severing cuts through the webs can be determined. This is important if the material webs have printing on them, for example, printing on a blank for a package. The two webs, that is to say the runoff web 10 and new web 13, can be controlled by suitable sensors 34, 35, assigned to each web, with the aid of printed markings. The printed markings detected by the sensors 34, 35 generate a control signal to drive members for the webs such that the latter are stopped in the correct position in the region of the connecting assembly 18.

The connecting assembly 18 comprises the pressure plate 31 and a counter-pressure member, namely a pressure piece 36 on the free side of the runoff web 10, that is to say below.

The runoff web 10 which, in the case of the present exemplary embodiment, is located beneath the new web 13 is guided in the region of the connecting assembly 18 by deflection rolls 37, 38. These are located on a carrying piece 39 on which the pressure piece 36 is also fitted. The carrying piece 39 can be moved up and down together with the pressure piece 36 and the deflection rolls 37, 38. A bottom position corresponds to the operating position during the drawing off of the runoff web 10 (shown in broken lines in FIG. 1). In this position, the web portion 29 of the new web 13 can be moved into the region of the connecting assembly 18 in the manner described.

Upon the upwards movement of the carrying piece 39 and the accompanying upwards movement of the pressure piece 36 the runoff web 10 is pressed, on the running off side or on the side directed towards the packaging machine, by the pressure piece 36 onto the new web 13 and, with the latter, onto the pressure plate 31. The runoff web 10 is then brought to a standstill. During the web-connecting procedure which then follows, the processing machine (packaging machine) can continue to run. The necessary web material is drawn, during this time, out of a web store 40 which is configured here as a multiple rocker. The processing machine is operated, during this phase, with reduced performance (dead slow).

While the runoff web 10 is pressed, in the position described, onto the new web 13 and onto the pressure plate 31, a severing cut through both webs takes place. For this purpose, a cutter 41 is moved transversely with respect to the webs. The cutter 41 runs in a groove 42 of the pressure plate 31. The cutter 41 is in this case fitted on a carriage 43 which can be displaced on transversely directed guide rods 44.

Figure 10:
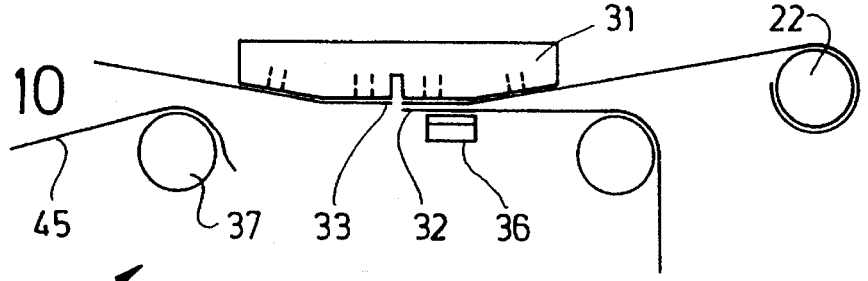

After the severing cut has been carried out, a web piece 45 directed towards the runoff bobbin 11, which has run empty, is free. As a result of the increased stressing in the runoff web 10, said web piece 45 is automatically drawn back out of the region of the connecting assembly 18 (FIG. 10).

The rest of the web parts resulting from the severing cut are retained in the given position within the connecting assembly 18. The separated web portion 29 of the new web 13 is retained on the pressure plate 31 by suction air which is generated via bores 46 on the downwardly directed abutment surface of the pressure plate 31. Furthermore, a section directed towards the receiving roller 22 is retained, together with the remaining runoff web 10, by the pressure piece 36.

By virtue of removing the web piece 45 of the runoff web 10, the web borders which are to be connected to one another, namely the web end 32, on the one hand, and the web beginning 33, on the other hand, then lie free, towards the bottom, one beside the other. Consequently, a connecting agent can then be provided on the two webs from the free side, in the present case this being an adhesive connecting strip 47 which runs transversely with respect to the webs. Said strip is, in the present case, pressed against the web end 32 and web beginning 33 from below, with the result that the runoff web 10 and new web 13 are thus connected to one another.

Figure 11:
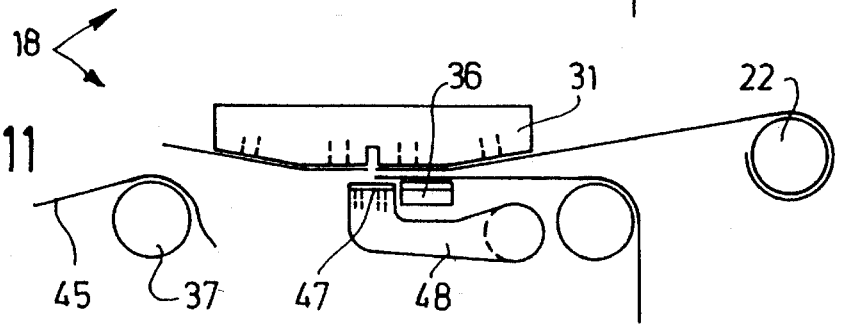

In order to handle the connecting strip 47, a strip-applying means 48 which can move up and down is fitted on the carrying piece 39. Said strip-applying means is, in the present case, a pivotable arm, having transversely directed legs and a retaining surface 49 for the connecting strip. By pivoting out of a downwardly directed, vertical position into a top, horizontal position (FIG. 11), the connecting strip 47 is pressed against the webs from below. The pressure piece 36 is positioned at the necessary distance from the web end 32 and web beginning 33.

Figure 12:
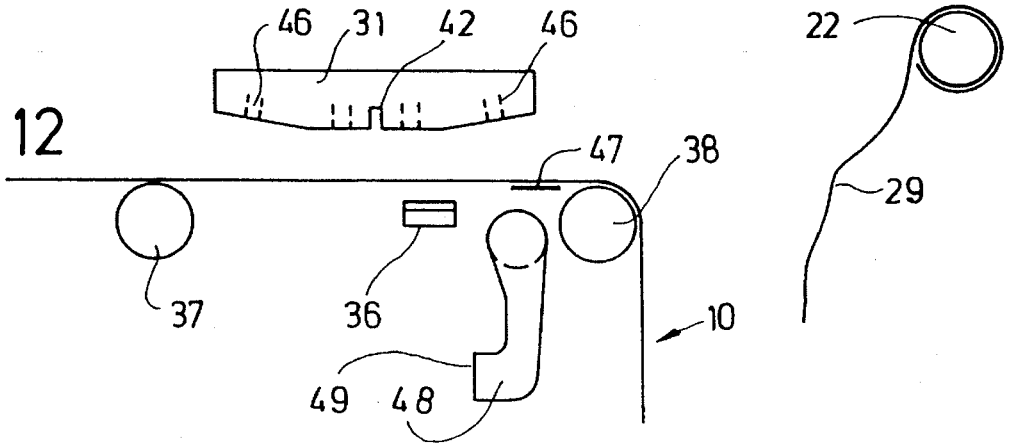

Once the connecting strip 47 has been provided on the runoff web 10 and new web 13, the carrying piece 39, along with the pressure piece 36 and the deflection rolls 37, 38, is lowered (FIG. 12). The now continuous (new) runoff web 10 is then transported further. The formerly new web 13 is moved, by pivoting the rocker 14, into the bottom position of the runoff bobbin 11. The remainder, which has likewise become free during this procedure, of the new web 13 or of the web portion 29 on the drawing-off member 20 is moved out of the region of the connecting assembly 18 and is then drawn off from the receiving roller 22.

In the bottom position of the pressure piece 36, the strip-applying means 48 is loaded with a new connecting strip. Provided for this purpose is a suitably configured transfer member 50 which positions the connecting strip 47 onto the retaining surface 49. The connecting strip 47 is retained on said retaining surface by suction air, via suction bores 51.

What is claimed is:

1. An apparatus having a connecting assembly (18) for connecting webs of packaging material, namely connecting a web beginning (33) of a new web (13), wound as a new bobbin (12), to a web end (32) of a runoff web (10), running off from another runoff bobbin (11), in the connecting assembly (18), said apparatus comprising:

a) a drawing-off member comprising retaining means (22) for gripping the web beginning (33) of the new web (13) on a circumference of the new bobbin (12) and for drawing-off the new web (13) from the new bobbin (12) in a continuous conveying cycle;

b) means for moving the web beginning (33) and an adjoining web portion (29) of the new web (13), while being drawn off from the new bobbin (12) in said continuous conveying cycle, into said connecting assembly (18) and beyond, said connecting assembly comprising an upper pressure member (31) and a lower pressure piece (36);

c) means, including said drawing-off member (20), for retaining the web beginning (33) and the adjoining web portion (29) of the new web (13) in a resting position until the new web (13) is connected to the runoff web (10);

d) means for moving the drawing-off member (20), along with the web beginning (33) and the web portion (29), along an underside of said pressure member (31) of the connecting assembly (18) such that the web portion (29) rests, in an end position, on said pressure member (31);

e) means for causing the pressure piece (36) to press the runoff web (10), in said connecting assembly (18), against the web portion (29) and against said pressure member (31);

f) a severing knife (41) for commonly severing the web portion (29) and the runoff web (10), the web end (32) of the runoff web (10) being fixed on the pressure member (31) by the pressure piece (36), and the web beginning (33) of the new web (13) being fixed on the pressure member (31) by suction air; and g) strip-applying means (48) for pressing a connecting strip (47) against the web end (32) and the web beginning (33) on said pressure member (31) to connect together the web end (32) and the web beginning (33).

2. The apparatus according to claim 1, wherein said strip-applying means (48) is fitted pivotably on a carrying piece (39), and is movable up and down together with the carrying piece (39), the strip-applying means (48), in a bottom end position, receiving the connecting strip (47) from a transfer member (50) and being pivotable in a top end position against the web end (32) and the web beginning (33).

3. The apparatus according to claim 1, wherein the drawing-off member (20) is a pivot arm (21) which is fixed against translational movement but which is pivotable in an upright plane, said retaining means being fitted at a free end of said pivot arm (21) for gripping an end piece (25) of the web beginning (33) of the new web (13).

4. The apparatus according to claim 1, wherein said retaining means for gripping an end piece (25) of the web beginning (33) of the new web (13) is a rotatable receiving roller (22) which has suction bores (23) for gripping the new web (13), and onto which the end piece (25) of the new web (13) is windable in order to retain said new web.

5. The apparatus according to claim 1, wherein the web portion (29) is fixed on the underside of the fixed pressure plate (31) by the suction air, and the runoff web (10), which is guided beneath the new web (13), is pressed against said new web (13) and the pressure plate (31) by an upward movement of said pressure piece (36) from a bottom position.

6. The apparatus according to claim 5, wherein said severing knife (41) is transversely moveable relative to a length dimension of the runoff and new webs, and is arranged on that side of the pressure piece (36) which is directed towards the new bobbin (12).

7. The apparatus according to claim 6, wherein said severing knife (41) is fitted on a displaceable carriage (43) which is displaceably mounted on guide rods (44) which are directed transversely with respect to the length dimension of the runoff web (10) and the new web (13).

* * * * *